US007124781B2

(12) United States Patent
Fahrer et al.

(10) Patent No.: US 7,124,781 B2
(45) Date of Patent: Oct. 24, 2006

(54) MULTIPLE CONTOUR BINDERS IN TRIPLE LAYER FABRICS

(75) Inventors: Ernest Fahrer, Kintzheim (FR); Monique Fagon, Erstein (FR)

(73) Assignee: Albany International Corp., Albany, NY (US)

( * ) Notice: Subject to any disclaimer, the term of this patent is extended or adjusted under 35 U.S.C. 154(b) by 0 days.

(21) Appl. No.: 11/048,183

(22) Filed: Feb. 1, 2005

(65) Prior Publication Data

US 2006/0169346 A1 Aug. 3, 2006

(51) Int. Cl.
*D21F 7/08* (2006.01)
*D21F 7/10* (2006.01)

(52) U.S. Cl. ..... 139/383 A; 162/358.2; 162/900

(58) Field of Classification Search ..... 139/383 A; 162/358.2, 900

See application file for complete search history.

(56) References Cited

U.S. PATENT DOCUMENTS 4,501,303 A 2/1985 Osterberg
5,052,448 A * 10/1991 Givin ..... 139/383 A
5,219,004 A * 6/1993 Chiu ..... 139/383 A
5,826,627 A * 10/1998 Seabrook et al. ..... 139/383 A
5,881,764 A 3/1999 Ward
6,202,705 B1 * 3/2001 Johnson et al. ..... 139/383 A
6,240,973 B1 * 6/2001 Stone et al. ..... 139/383 A
6,334,467 B1 1/2002 Barrett et al.
6,581,645 B1 * 6/2003 Johnson et al. ..... 139/383 A
6,854,488 B1 * 2/2005 Hay et al. ..... 139/383 A
6,883,556 B1 * 4/2005 Fahrer et al. ..... 139/383 A
6,920,902 B1 * 7/2005 Majaury et al. ..... 139/383 A

FOREIGN PATENT DOCUMENTS

WO WO 2004/111333 A 12/2004

* cited by examiner

*Primary Examiner*—John J. Calvert
*Assistant Examiner*—Robert H Muromoto
(74) *Attorney, Agent, or Firm*—Frommer Lawrence & Haug LLP; Ronald R. Santucci

(57) ABSTRACT

A multi-layer fabric which may be utilized in a papermaking process. Such fabric has a first layer of machine direction (MD) yarns, a second layer of MD yarns and a first system of cross-direction (CD) yarns having first binder yarns weaving a first contour pattern and second binder yarns weaving a second contour pattern different from the first contour pattern. The first binder yarns and the second binder yarns are each intrinsic to the first layer and each bind with the second layer. Moreover, the binder yarns each weave in sequence in the first layer more than once in a pattern repeat of the fabric. The binder yarns also weave plural contour patterns in the first layer in the weave pattern repeat.

14 Claims, 7 Drawing Sheets

MULTIPLE CONTOUR BINDERS IN TRIPLE LAYER FABRICS

BACKGROUND OF THE INVENTION

1. Field of the Invention

The present invention relates to the papermaking arts. More specifically, the present invention relates to fabrics, such as forming fabrics, for use with a paper making machine.

2. Description of the Prior Art

During the papermaking process, a cellulosic fibrous web is formed by depositing a fibrous slurry, that is, an aqueous dispersion of cellulose fibers, onto a moving forming fabric in the forming section of a paper machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

It should be appreciated that the forming, press and dryer fabrics all take the form of endless loops on the paper machine and function in the manner of conveyors. It should further be appreciated that paper manufacture is a continuous process which proceeds at considerable speeds. That is to say, the fibrous slurry is continuously deposited onto the forming fabric in the forming section, while a newly manufactured paper sheet is continuously wound onto rolls after it exits from the dryer section.

Press fabrics also participate in the finishing of the surface of the paper sheet. That is, press fabrics are designed to have smooth surfaces and uniformly resilient structures, so that, in the course of passing through the press nips, a smooth, mark-free surface is imparted to the paper.

Press fabrics accept the large quantities of water extracted from the wet paper in the press nip. In order to fill this function, there literally must be space, commonly referred to as void volume, within the press fabric for the water to go, and the fabric must have adequate permeability to water for its entire useful life. Finally, press fabrics must be able to prevent the water accepted from the wet paper from returning to and rewetting the paper upon exit from the press nip.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

Woven fabrics take many different forms. For example, they may be woven endless, or flat woven and subsequently rendered into endless form with a seam.

The present invention may relate specifically to the forming fabrics used in the forming section. Forming fabrics play a critical role during the paper manufacturing process. One of its functions, as implied above, is to form and convey the paper product being manufactured to the press section.

However, forming fabrics also need to address water removal and sheet formation issues. That is, forming fabrics are designed to allow water to pass through (i.e. control the rate of drainage) while at the same time prevent fiber and other solids from passing through with the water. If drainage occurs too rapidly or too slowly, the sheet quality and machine efficiency suffers. To control drainage, the space within the forming fabric for the water to drain, commonly referred to as void volume, must be properly designed.

Contemporary forming fabrics are produced in a wide variety of styles designed to meet the requirements of the paper machines on which they are installed for the paper grades being manufactured. Generally, they comprise a base fabric woven from monofilament and may be single-layered or multi-layered. The yarns are typically extruded from any one of several synthetic polymeric resins, such as polyamide and polyester resins, used for this purpose by those of ordinary skill in the paper machine clothing arts.

The design of forming fabrics additionally involves a compromise between the desired fiber support and fabric stability. A fine mesh fabric may provide the desired paper surface and fiber support properties, but such design may lack the desired stability resulting in a short fabric life. By contrast, coarse mesh fabrics provide stability and long life at the expense of fiber support and the potential for marking. To minimize the design tradeoff and optimize both support and stability, multi-layer fabrics were developed. For example, in double and triple layer fabrics, the forming side is designed for sheet and fiber support while the wear side is designed for stability, void volume, and wear resistance.

In addition, triple layer designs allow the forming surface of the fabric to be woven independently of the wear surface. Because of this independence, triple layer designs can provide a high level of fiber support and an optimum internal void volume. Thus, triple layers may provide significant improvement in drainage over single and double layer designs.

Essentially, triple layer fabrics consist of two fabrics, the forming layer and the wear layer, held together by binding yarns. The binding is extremely important to the overall integrity of the fabric. One problem with triple layer fabrics has been relative slippage between the two layers which breaks down the fabric over time. In addition, the binding yarns can disrupt the structure of the forming layer resulting in marking of the paper.

Those skilled in the art will appreciate that fabrics are created by weaving, and have a weave pattern which repeats in both the warp or machine direction (MD) and the weft or cross-machine direction (CD).

Multi-layer fabrics, such as triple layer fabrics, may have unacceptable resistance to internal abrasion and/or the weave may loosen (i.e. the yarns may slide from their original positions within the pattern) during use. The present invention provides a fabric which overcomes such disadvantages.

SUMMARY OF THE INVENTION

Accordingly, the present invention is a multi-layer fabric which may be usable in the forming, pressing and/or drying sections of a paper making machine. The layers of such fabric may be held together by use of a plurality of binder yarns which each weave in sequence in the first layer more than once within each weave pattern repeat. In other words, each of the binder yarns weaves in the top layer and/or the bottom layer of the fabric more than once in each pattern repeat.

According to an aspect of the present invention, a fabric is provided which comprises a first layer of machine direction (MD) yarns, a second layer of MD yarns and a first system of cross-direction (CD) yarns having first binder yarns weaving a first contour pattern and second binder yarns weaving a second contour pattern different from the first contour pattern. The first binder yarns and the second binder yarns are each intrinsic to the first layer and each bind with the second layer. Moreover, in another aspect of the invention, the first binder yarns and the second binder yarns each weave in sequence in the first layer more than once in a weave pattern repeat.

Another aspect of the present invention is that the first binder yarns and the second binder yarns may combine to weave each MD yarn in the first layer, thereby producing a plain weave pattern in the first layer.

Other aspects of the present invention include that the fabric may be a triple layer forming fabric. The first layer which comprises a first layer of MD yarns may form a forming side of the fabric and the second layer which comprises a second layer of MD yarns may form a wear side of the fabric. The first binder yarns and the second binder yarns may each cross from the second layer to the first layer more than once in a pattern repeat. The fabric may further comprise a second system of CD yarns interwoven with the first layer of MD yarns and/or a third system of CD yarns interwoven with the second layer of MD yarns. The fabric may have a forming side to wear side shute ratio of 1:1, 2:1, 3:2, 3:1, or any other suitable shute ratio. The fabric may be produced in a 40 harness arrangement and may preferably be flat woven. Also, the MD yarns of the first layer and the second layer may be in vertically stacked positions relative thereto. At least some of the MD yarns and CD yarns may be monofilament yarns; may be one of polyamide yarns or polyester yarns; and may have a circular cross-sectional shape, a rectangular cross-sectional shape or another non-round cross-sectional shape.

For purposes of this application, cross machine direction yarns may be described as CD yarns, weft yarns, or shute yarns. The binder yarns are all also in the cross machine direction.

The present invention will now be described in more complete detail with reference being made to the drawing figures, which are identified below in which corresponding components are identified by the same reference numerals.

BRIEF DESCRIPTION OF THE DRAWINGS

For a more complete understanding of the invention, reference is made to the following description and accompanying drawings, in which.

DETAILED DESCRIPTION OF THE PREFERRED EMBODIMENTS

The present invention pertains to a fabric such as a triple layer fabric which may be utilized in a papermaking process. Such triple layer fabrics include a first (top) layer and a second (bottom) layer in which each of the first and second layers has a system of machine-direction (MD) yarns and cross-machine direction (CD) yarns interwoven therewith. The first layer may be a paper side or forming layer upon which the cellulosic paper/fiber slurry is deposited during the papermaking process and the second layer may be a machine side or wear side layer. The first and second layers are held together by use of a number of binder yarns.

In a first aspect of the present invention, each binder yarn weaves in sequence with the top layer more than once in a pattern repeat. Further, in a second aspect of the invention, the binder yarns weave plural contour patterns in the top layer in the pattern repeat. As used herein, plural contour patterns is defined to mean each binder yarn in a binder pair weaves a different pattern; thereby producing at least two contour patterns. In other words, the first and second binder yarns produce different pattern contours in the top layer.

The present invention is a derivative of the sheet support binder (SSB) concept in which the binder yarns are typically part of the structure supporting the fabric. Commonly, these binder yarns are paired weft binder yarns intrinsic to the forming layer and simply bind with the wear side layer, although these binder yarns may also be intrinsic to the wear side layer. In a preferred embodiment of the present invention, the binder yarns combine to produce a plain weave pattern with the topside MD yarns and are therefore intrinsic to the top layer.

Figure 1:
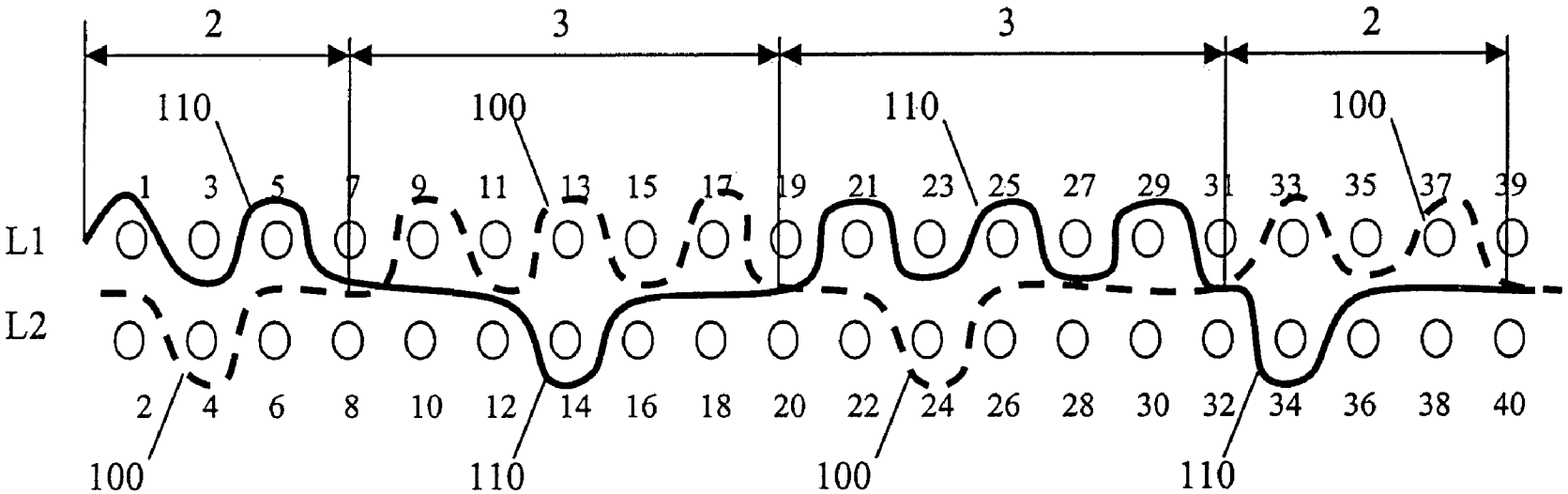
FIG. 1 is a cross-sectional view showing the binder yarn contours of a fabric according to an embodiment of the present invention.

Papermaking forming fabrics are commonly woven on a 20 harness loom. This means the fabrics have 20 total warp yarns of which 10 are forming side warp yarns and 10 are wear side warp yarns. The present invention is especially adapted for weaving on a 40 harness loom setup, but is not limited as such. In other words, the present fabrics typically have 40 total warp yarns, wherein there are 20 top layer warp yarns and 20 bottom layer warp yarns. Fabrics woven with a greater number of harnesses than 40 are also intended to be covered by the present invention FIG. 1 is a cross-sectional view of an exemplary fabric according to the teachings of the present invention which shows the plural contours of the binder yarns as they weave with the MD yarns in the top (forming) layer and bind the bottom (wear side) layer. This example fabric is referred to as having a 2,3+3,2 contour pattern. The paired numbers indicate the number of knuckles made by the binder yarn each time the binder yarn weaves in the top layer. For purposes of this application, a knuckle is formed when a CD yarn passes over one or more MD yarns on the outer surface of the fabric. The plus indicates the presence of a following binder yarn; i.e. the other binder yarn of the pair. For example, in the fabric shown in FIG. 1 the first binder yarn 110 starts in the top layer L1 and passes over MD yarn 1, under MD yarn 3, over MD yarn 5, and under MD yarn 7 where it crosses with the second binder yarn 100. In this manner, the first binder yarn forms two knuckles. The first binder yarn then traverses to the bottom layer L2 and binds with MD yarn 14 before traversing back to the top layer where it crosses with the second binder yarn 100 under MD yarn 19. This time in the top layer, the first binder yarn 110 passes over MD yarn 21, under MD yarn 23, over MD yarn 25, under MD yarn 27, over MD yarn 29, and under MD yarn 31. In this manner, the first binder yarn 110 forms the next 3 knuckles of its contour. The first binder yarn then traverses to the bottom layer L2 and binds with MD yarn 34 before traversing back to the top layer where it crosses with the second binder yarn under MD yarn 40 to complete one repeat of the weave pattern. Hence, the first binder yarn is designated as having a 2,3 contour pattern. The second binder yarn 100 begins the pattern in the bottom layer L2 where it binds with MD yarn 4 before traversing to the top layer L1 under MD yarn 7. The second binder yarn 100 passes over MD yarn 9, under MD yarn 11, over MD yarn 13, under MD yarn 15, and over MD yarn 17 to form the first three knuckles of the second binder yarn's contour. The second binder yarn then traverses back to the bottom layer L2 and binds with MD yarn 24 before returning to the top layer at MD yarn 31. The second binder yarn then passes over MD yarn 33, under MD yarn 35, over MD yarn 37, and under MD yarn 39 to form the last two knuckles of the second binder yarn's contour and to complete the weave pattern repeat. Hence, the second binder yarn is designated as having a 3,2 contour pattern and the fabric is identified by its binder yarn patterns as 2,3+3,2. Note the first and second binder yarns' contours combine to weave every other MD yarn in the top layer, thereby producing a plain weave pattern in the top layer. Also note the binders are intrinsic to the top layer and simply bind with the bottom layer.

Numerous permutations of the binder yarn contours shown in FIG. 1 are encompassed by the present invention. Table 1 provides an abbreviated list of patterns based on permutations of the binder yarn contour pattern shown in FIG. 1. For example, pattern A corresponds to the 2,3+3,2 pattern shown in FIG. 1, pattern B is a permutation of pattern A wherein the first and second binder yarns exchange contours, and pattern C is a permutation wherein the first binder yarn has a 2,2 contour pattern and the second binder yarn has a 3,3 contour pattern. Moreover, each binder yarn can bind (i.e. lock) different numbers of times with the bottom layer. Alternative patterns A1–A# (which are permutations of pattern A) differ only in how each binder yarn locks (or binds) with the bottom layer. In FIG. 1 (i.e. pattern A), both binder yarns lock a single MD yarn each of the two times they cross to the bottom layer in the pattern repeat. Hence, each binder yarn in pattern A has two locks with the bottom layer in a pattern repeat. For alternative pattern A1, binder yarn 1 has only one lock with the bottom layer. This means binder yarn 1 does not lock an MD yarn during one of the two times it crosses to the bottom layer in the pattern repeat. For the patterns shown in Table 1, each binder yarn can have up to 5 locks in a pattern repeat. Permutations of pattern A can be formed using any combination of locks up to five each for binder 1 and binder 2. Although only a few of the possible permutations have been listed in Table 1, the present invention is intended to cover all possible permutations and should not be limited as such.

TABLE 1

Binder Yarn Contour Pattern Permutations of FIG. 1

| Patterns | Binder 1 | | Binder 2 | |
|---|---|---|---|---|
| A (=FIG. 1) | 2,3 | two locks | 3,2 | two locks |
| B (=Permuted FIG. 1) | 3,2 | two locks | 2,3 | two locks |
| C (=Permuted FIG. 1) | 2,2 | two locks | 3,3 | two locks |
| Alt A1 | 2,3 | one lock | 3,2 | one lock |
| Alt A2 | | one lock | | two locks |
| Alt A3 | | one lock | | three locks |
| Alt A4 | | one locks | | four locks |
| Alt A5 | | one locks | | five locks |
| Alt A6 | | two locks | | one lock |
| . . . | | . . . | | . . . |
| Alt A# | | five locks | | five locks |

Figure 2:
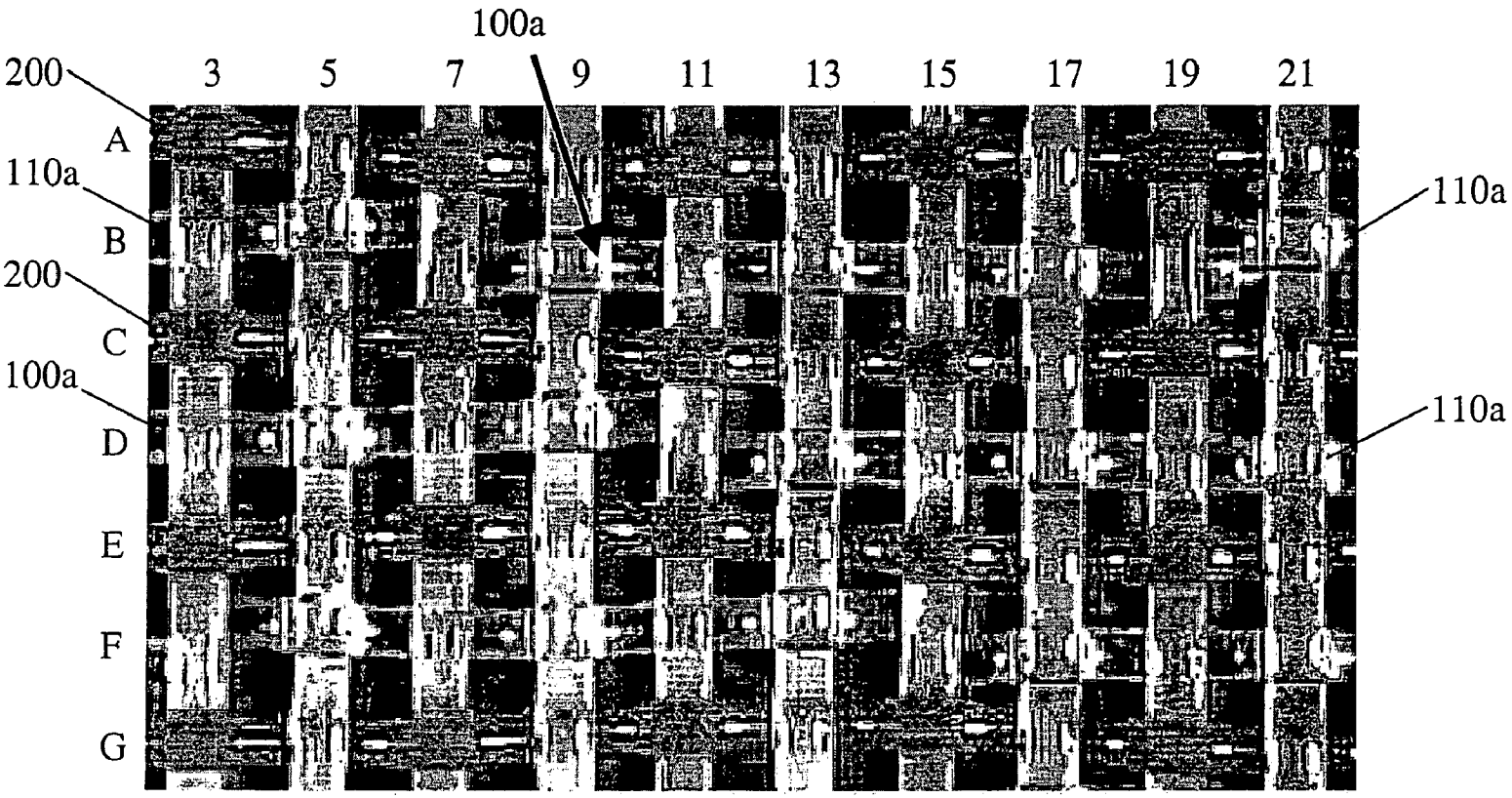
FIG. 2 is a forming surface view of the fabric shown in FIG. 1.

FIG. 2 is a forming surface view of a partial pattern repeat of the exemplary fabric shown in FIG. 1. MD yarns run vertically in the figure and are numbered to correspond with the top layer MD yarns shown in FIG. 1. Note, even-numbered MD yarns correspond to the bottom layer and are therefore not shown. CD yarns run horizontally in the figure and have been assigned reference rows A–G as shown. This fabric has a 2:1 shute ratio; meaning a CD yarn is woven into the top layer between each set of binder yarns. In this case, the CD yarns 200 are shutes woven in a plain weave pattern between each binder yarn pair. Specifically, rows A, C, E, and G are shutes while rows B, D, and F are binder yarn pairs. These shutes are not shown in FIG. 1, where only the binder yarn contours are shown. Hereinafter reference numbers with an "a" designation indicate that only a partial weave pattern repeat is shown; e.g. 110*a* indicates that only a partial weave pattern repeat of first binder yarn 100 is shown. Row B (which matches the pattern shown in FIG. 1) starts with first binder yarn 110*a* passing under MD yarn 3 and over MD yarn 5 before crossing second binder yarn 100*a* under MD yarn 7. Second binder yarn 100*a* then passes over MD yarn 9, under MD yarn 11, over MD yarn 13, under MD yarn 15 and over MD yarn 17 before crossing with first binder yarn 110*a* under MD yarn 19. First binder yarn 110*a* then passes over MD yarn 21. (The start and end of each binder yarn contour is not shown) FIG. 2 also shows how each pair of binder yarns is staggered/shifted to the left by 4 top layer MD yarns. For example, the point in the contour pattern shown at MD yarn 19 in row B occurs at MD yarn 11 in row D and at MD yarn 3 in row F. FIG. 2 illustrates how the first binder yarn 110*a* and second binder yarn 100*a* combine to produce a plain weave pattern in the top layer.

Figure 3:
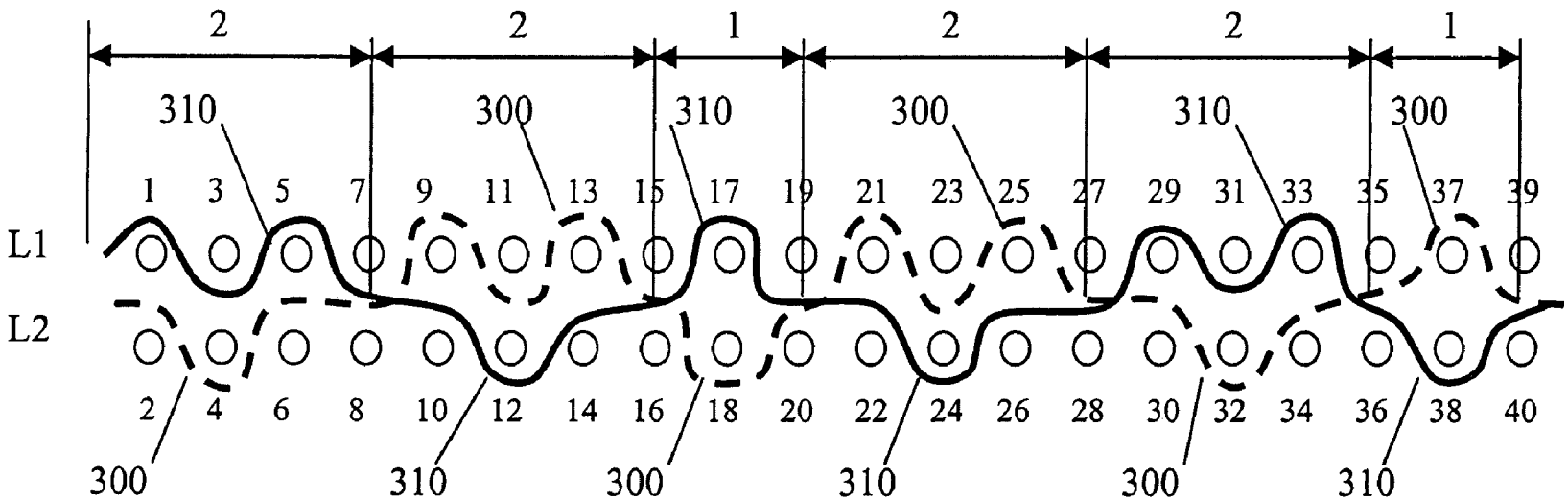
FIG. 3 is a cross-sectional view showing the binder yarn contours of a fabric according to another embodiment of the present invention.

FIG. 3 is a cross-sectional view of another exemplary fabric according to the teachings of the present invention which also shows the plural contours of the binder yarns as they weave with the MD yarns in the top (forming) layer and bind the bottom (wear side) layer. This fabric example has a system of two binder yarns and is referred to as having a 2,1,2+2,2,1 contour pattern. As shown in FIG. 3, the first binder yarn 310 starts in the top layer L1 and passes over MD yarn 1, under MD yarn 3, over MD yarn 5, and under MD yarn 7 where it crosses with the second binder yarn 300. In this manner, the first binder yarn 310 forms the first 2 knuckles of its contour. The first binder yarn then traverses to the bottom layer L2 and binds with one MD yarn 12 before traversing back to the top layer where it crosses with the second binder yarn 300 under MD yarn 15. This time in the top layer L1, the first binder yarn 310 only passes over MD yarn 17 to form a single knuckle. The first binder yarn traverses back to the bottom layer L2 and binds with MD yarn 24 before returning to the top layer where it crosses with the second binder yarn 300 under MD yarn 27. The first binder yarn 310 then passes over MD yarn 29, under MD yarn 31, and over MD yarn 33 to form 2 more knuckles before crossing the second binder yarn under MD 35. The first binder yarn traverses back to the bottom layer L2 and binds with MD yarn 38 before returning to the top layer to complete one repeat of the weave pattern. Hence, the first binder yarn is designated as having a 2,1,2 contour pattern. The second binder yarn 300 begins the pattern in the bottom layer L2 where it binds with MD yarn 4 before traversing to the top layer L1 under MD yarn 7. The second binder yarn passes over MD yarn 9, under MD yarn 11, over MD yarn 13 and under MD yarn 15 to form two knuckles of its contour. The second binder yarn traverses back to the bottom layer and binds with MD yarn 18 before returning to the top layer at MD yarn 19. The second binder yarn 300 passes over MD yarn 21, under MD yarn 23, over MD yarn 25, and under MD yarn 27 to form the next two knuckles of its contour. The second binder yarn traverses back to the bottom layer and binds with MD yarn 32 before returning to the top layer at MD yarn 35. The second binder yarn then passes over MD yarn 37 to form the last knuckle of its contour and to complete the weave pattern repeat. Hence, the second binder yarn is designated as having a 2,2,1 contour pattern and the fabric is identified by its binder yarn patterns as 2,1,2+2,2,1. The first and second binder yarns' contours combine to weave every other MD yarn in the top layer, thereby producing a plain weave pattern in the top layer. The binder yarns are also intrinsic to the top layer and simply bind the bottom layer.

Figure 4:
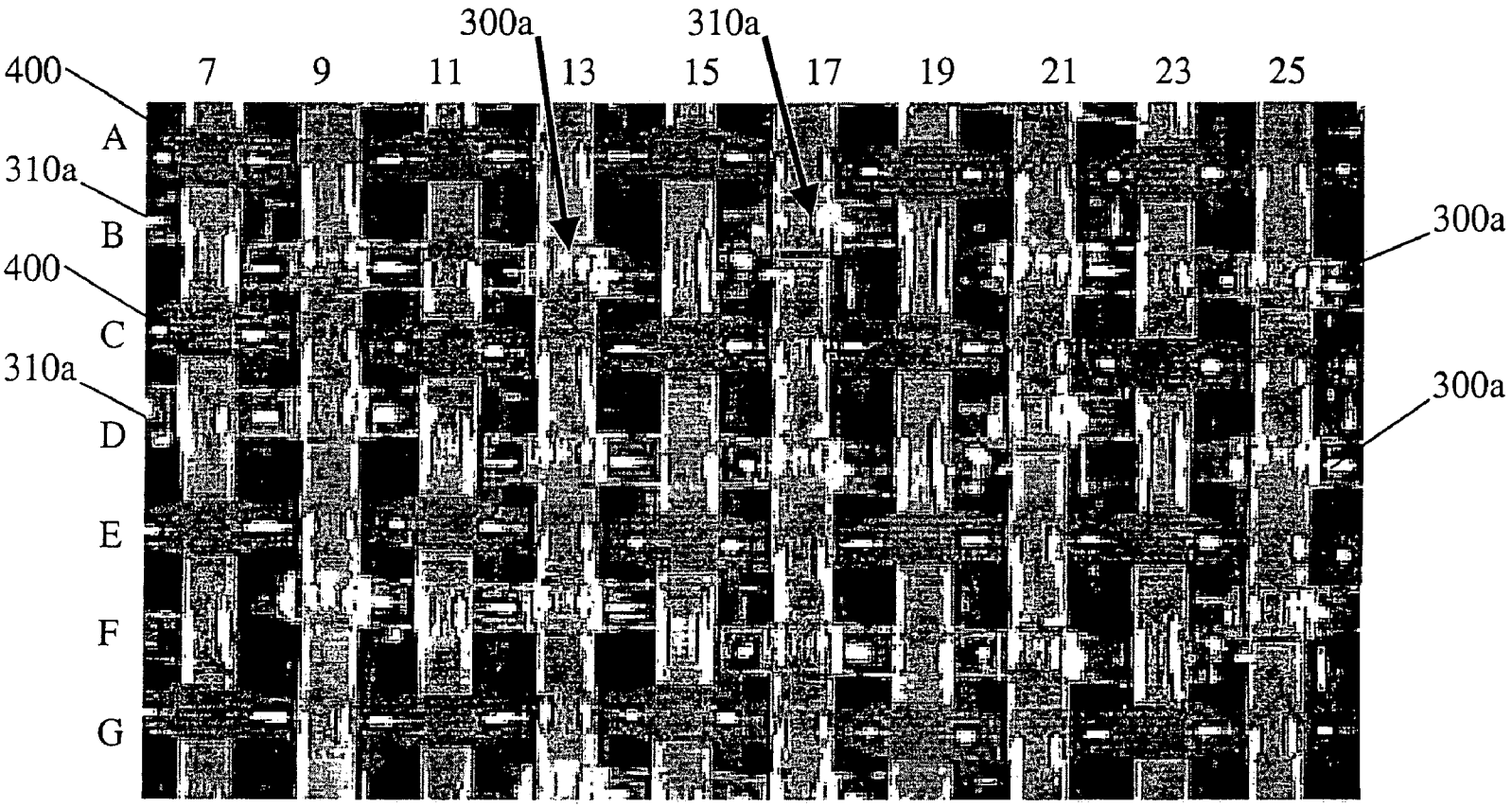
FIG. 4 is a forming surface view of the fabric shown in FIG. 3.

FIG. 4 is a forming surface view of a partial pattern repeat of the exemplary fabric shown in FIG. 3. As in FIG. 2, CD yarns 400 are woven in a plain weave between each binder yarn pair to produce a 2:1 forming side to wear side shute ratio fabric. Note these CD yarns are not shown in FIG. 3, where only the binder yarn contours are shown. In row B (which matches the pattern shown in FIG. 3), first binder yarn 310*a* passes under MD yarn 7 and crosses second binder yarn 300*a* which passes over MD yarn 9, under MD yarn 11, over MD yarn 13, and under MD yarn 15 to form the first 2 knuckles of its contour. First binder yarn 310*a* forms its next knuckle in the top layer by passing over MD yarn 17 before crossing with second binder yarn 300*a* under MD yarn 19. Second binder yarn 300*a* then passes over MD yarn 21, under MD yarn 23, and over MD yarn 25. (The remainder of the contour patterns are not shown) FIG. 4 also shows how each pair of binder yarns is staggered/shifted to the right by 2 top layer MD yarns. For example, the point in the pattern shown at MD yarn 17 in row B occurs at MD yarn 21 in row D and at MD yarn 25 in row F. FIG. 4 illustrates how the first binder yarn 310*a* and second binder yarn 300*a* combine to produce a plain weave pattern in each row of the top layer.

Figure 5:
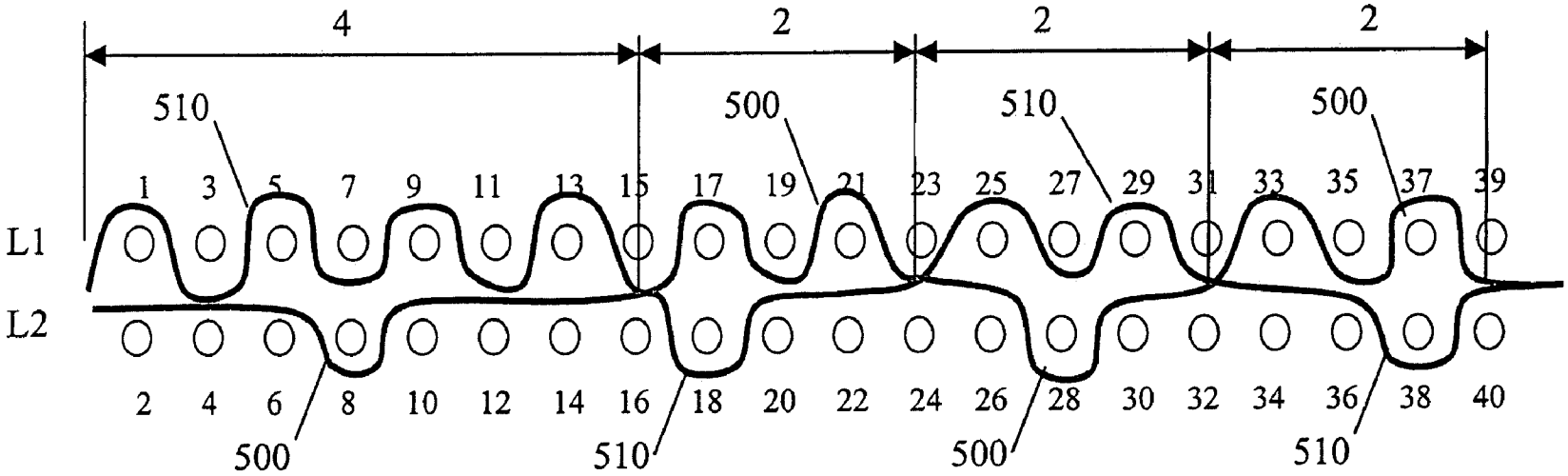
FIG. 5 is a cross-sectional view showing the binder yarn contours of a fabric according to still another embodiment of the present invention.

FIG. 5 is a cross-sectional view of still another exemplary fabric according to the teachings of the present invention which also shows the plural contours of the binder yarns as they weave with the MD yarns in the top (forming) layer and bind the bottom (wear side) layer. This fabric example has a system of two binder yarns and is referred to as having a 4,2+2,2 contour pattern. As shown in FIG. 5, the first binder yarn 510 starts in the top layer L1 and passes over MD yarn 1, under MD yarn 3, over MD yarn 5, under MD yarn 7, over MD yarn 9, under MD yarn 11, over MD yarn 13, and under MD yarn 15 where it crosses with the second binder yarn 500. In this manner, the first binder yarn 510 forms its first four knuckles. The first binder yarn then traverses to the bottom layer L2 and binds with MD yarn 18 before traversing back to the top layer where it crosses with the second binder yarn 500 under MD yarn 23. This time in the top layer L1, the first binder yarn 510 passes over MD yarn 25, under MD yarn 27, over MD yarn 29 and under MD yarn 31 to form two more knuckles. The first binder yarn traverses back to the bottom layer L2 and binds with MD yarn 38 before returning to the top layer to complete one repeat of the weave pattern. Hence, the first binder yarn is designated as having a 4,2 contour pattern. The second binder yarn 500 begins the pattern in the bottom layer L2 where it binds with MD yarn 8 before traversing to the top layer L1 under MD yarn 15. The second binder yarn passes over MD yarn 17, under MD yarn 19, over MD yarn 21 and under MD yarn 23 to form two knuckles of its contour. The second binder yarn traverses back to the bottom layer and binds with MD yarn 28 before returning to the top layer at MD yarn 31. The second binder yarn 500 passes over MD yarn 33, under MD yarn 35, over MD yarn 37, and under MD yarn 39 to form the next two knuckles of its contour and to complete the weave pattern repeat. Hence, the second binder yarn is designated as having a 2,2 contour pattern and the fabric is identified by its binder patterns as 4,2+2,2. The first and second binder yarns' contours combine to weave every other MD yarn in the top layer, thereby producing a plain weave pattern in the top layer. The binder yarns are also intrinsic to the top layer and simply bind the bottom layer. Various permutations of this pattern are also possible. For example, a fabric may have a 2,2+4,2 binder pattern contour. Further, various numbers of shutes may be added between the binder yarn pairs.

Figure 6:
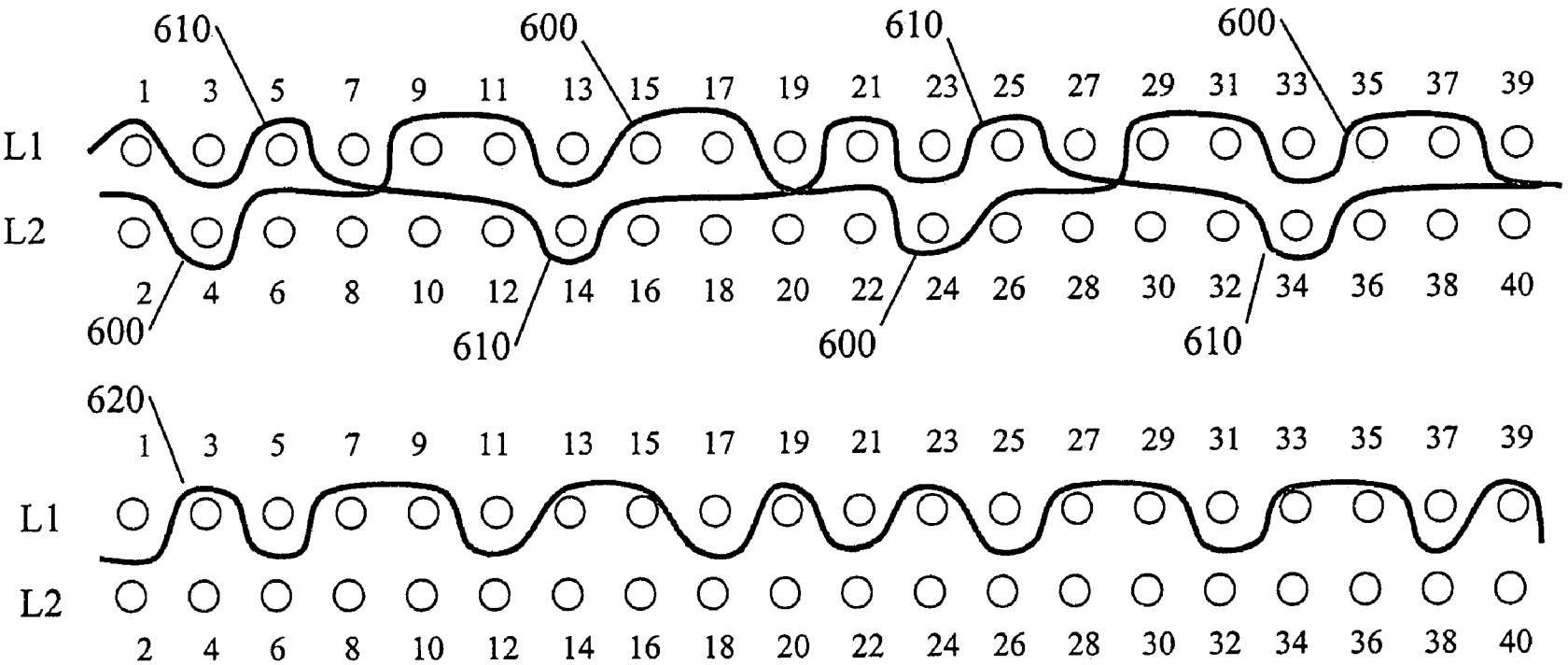
FIG. 6 is a cross-sectional view showing the binder yarn contours of a fabric in accordance with the teachings of the present invention that does not have a plain weave pattern in the top layer; a top layer shute between the binder yarn pairs is also shown.
Figure 7:
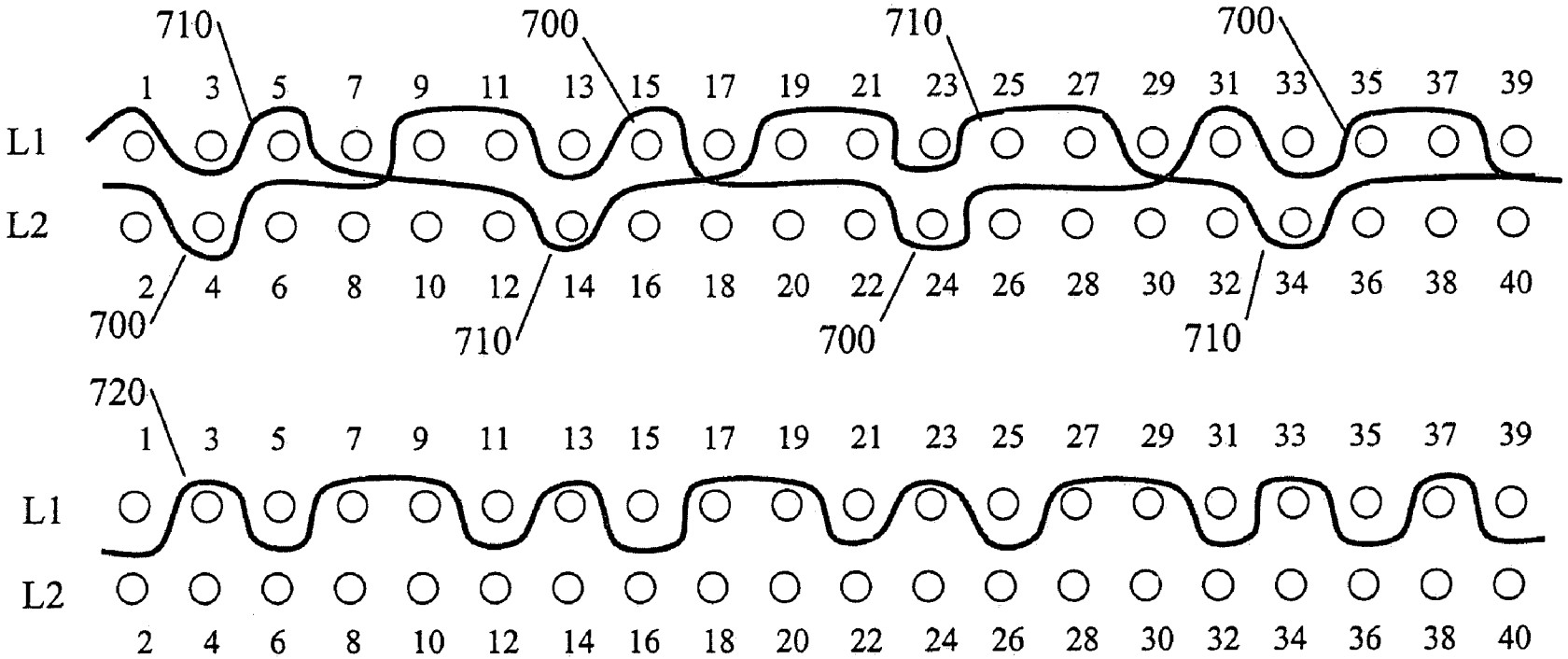
FIG. 7 is a cross-sectional view showing the binder yarn contours of another fabric in accordance with the teachings of the present invention that does not have a plain weave pattern in the top layer; a top layer shute between the binder yarn pairs is also shown.

FIGS. 6 and 7 show cross-sectional views of the plural binder yarn contours of an exemplary fabric that does not have a plain weave pattern in the top layer L1. As shown in FIG. 6, the first binder yarn 610 passes over MD yarn 1, under MD yarn 3, and over MD yarn 5; crosses to the bottom layer L2 and binds with MD yarn 14; crosses back to the top layer L1 and passes over MD yarn 21, under MD yarn 23, and over MD yarn 25; and again crosses to the bottom layer and binds MD yarn 34. Whereas, the second binder yarn 600 starts by binding with MD yarn 4 in the bottom layer L2, crosses to the top layer L1 and passes over MD yarns 9 and 11, under MD yarn 13, and over MD yarns 15 and 17 before crossing back to the bottom layer and binding with MD yarn 24; and finally crosses back to the top layer and again passes over MD yarns 29 and 31, under MD yarn 33, and over MD yarns 35 and 37. This contour results in a top layer pattern that is not a 2-shed surface. As shown in FIG. 7, binder yarns 700 and 710 both have contours that result in a non-plain weave surface pattern. CD yarns 620 and 720 in FIGS. 6 and 7 respectively, are top layer shutes woven into the fabric between the pairs of binder yarns.

Other aspects of the present invention include that the pattern may have forming to wear-side shute ratios of 1:1, 2:1, 3:2, 3:1, or any other shute ratio known in the art. The forming side to wear side shute ratio is defined herein as being the ratio of shutes (or CD yarns) in the first layer to shutes in the second layer; with each pair of CD binder yarns counting as a single shute. Another ratio is the forming side binder shute ratio which is the ratio of binder pairs in the first layer to regular CD yarns (shutes) in the first layer. Fabrics according to the present invention may have forming side binder shute ratios of 1:0 (100% binder pairs), 1:1, 1:2, 1:3, etc. . . . The warp ratio is the ratio of MD yarns in the first layer to the second layer. The present invention covers fabrics having warp ratios of 1:1 (as shown in the Figures), 2:1, 3:2, etc. . . . The MD yarns in the top layer may be vertically stacked over the MD yarns in the bottom layer. The binding yarns can simply act to bind the wear side or they can weave integrally with the wear side pattern. Note, these examples are simply representative examples of the invention and are not meant to limit the invention.

The fabric according to the present invention may comprise monofilament yarns. The yarns may be polyester monofilament and/or some may be polyester or polyamide. In addition, the fabric may comprise multifilament yarns, plied or mono-filament yarns, bi-component yarns, and/or any other suitable yarns known in the art. The yarns may have a circular cross-sectional shape with one or more different diameters. Further, in addition to a circular cross-sectional shape, one or more of the yarns may have other cross-sectional shapes such as a rectangular cross-sectional shape or another non-round cross-sectional shape.

Additionally, although the present invention has been described as usable for the papermaking process, the present invention is not so limited. That is, the present fabric may be utilized for other uses.

Modifications to the above would be obvious to those of ordinary skill in the art, but would not bring the invention so modified beyond the scope of the present invention. The claims to follow should be construed to cover such situations.

What is claimed is:

1. A papermaker's fabric, comprising:

a first layer of machine direction (MD) yarns;

a second layer of MD yarns;

a first system of cross-machine direction (CD) yarns comprising first binder yarns weaving a first contour pattern and second binder yarns weaving a second contour pattern different from the first contour pattern;

wherein the first binder yarns and the second binder yarns are each intrinsic to the first layer and each bind with the second layer; and wherein the first binder yarns and the second binder yarns each weave in sequence in the first layer more than once in a pattern repeat.

2. The papermaker's fabric according to claim 1, wherein the fabric is a triple layer forming fabric.

3. The papermaker's fabric according to claim 1, wherein the first layer of MD yarns forms a forming side of the fabric and the second layer of MD yarns forms a wear side of the fabric.

4. The papermaker's fabric according to claim 1, wherein the first binder yarns and the second binder yarns each cross from the second layer to the first layer more than once in a pattern repeat.

5. The papermaker's fabric according to claim 1, further comprising a second system of CD yarns interwoven with the first layer between pairs of the first system binder yarns.

6. The papermaker's fabric according to claim 1, further comprising a third system of CD yarns interwoven with the second layer.

7. The papermaker's fabric according to claim 1, wherein the first binder yarns and the second binder yarns combine to weave each MD yarn in the first layer.

8. The papermaker's fabric according to claim 1, wherein the fabric is produced in a 40 harness arrangement.

9. The papermaker's fabric according to claim 1, wherein the fabric is flat woven.

10. The papermaker's fabric according to claim 1, wherein the first binder yarns and the second binder yarns each weave with the first layer more than once in the pattern repeat.

11. The papermaker's fabric according to claim 1, wherein at least some of the MD yarns and CD yarns are monofilament yarns.

12. The fabric according to claim 1, wherein at least some of the MD yarns and CD yarns are one of polyamide yarns or polyester yarns.

13. The fabric according to claim 1, wherein at least some of the MD yarns and CD yarns have one of a circular cross-sectional shape, a rectangular cross-sectional shape and a non-round cross-sectional shape.

14. A papermaker's fabric, comprising:

a first layer of machine direction (MD) yarns;

a second layer of MD yarns;

a first system of cross-machine direction (CD) yarns comprising first binder yarns weaving a first contour pattern and second binder yarns weaving a second contour pattern different from the first contour pattern; the first and second binder yarns being paired to form binder yarn pairs;

a second system of CD yarns interwoven with the first layer between binder yarn pairs;

wherein the first binder yarns and the second binder yarns are each intrinsic to the first layer and each bind with the second layer; and wherein the first binder yarns and the second binder yarns each weave in sequence in the first layer more than once in a pattern repeat.

* * * * *